United States Patent [19]

Guendel

[11] Patent Number: 4,938,718

[45] Date of Patent: Jul. 3, 1990

[54] CYLINDRICAL CONNECTOR KEYING MEANS

[75] Inventor: Herbert W. Guendel, Camp Hill, Pa.

[73] Assignee: AMP Incorporated, Harrisburg, Pa.

[21] Appl. No.: 742,171

[22] Filed: Jun. 7, 1985

Related U.S. Application Data

[63] Continuation of Ser. No. 235,455, Feb. 18, 1981, abandoned.

[51] Int. Cl.[5] ..... H01R 13/64

[52] U.S. Cl. ..... 439/680; 439/320; 439/901

[58] Field of Search ..... 339/184 R, 184 M, 186 R, 339/186 M; 439/680, 681, 320, 901

[56] References Cited

U.S. PATENT DOCUMENTS

| | | | |
|---|---|---|---|
| 2,410,618 | 11/1946 | Zelov | 439/97 |
| 2,418,457 | 4/1947 | Born | 439/701 |
| 3,221,292 | 11/1965 | Swanson | 439/589 |
| 3,576,517 | 4/1971 | Johnson et al. | 439/274 |
| 3,840,839 | 10/1974 | Smaczny et al. | 439/294 |
| 3,892,458 | 7/1975 | Clark | 439/319 |
| 3,901,574 | 8/1975 | Paullus et al. | 439/315 |
| 4,193,655 | 3/1980 | Herrmann, Jr. | 439/166 |
| 4,229,064 | 10/1980 | Vetter et al. | 439/680 |

FOREIGN PATENT DOCUMENTS 2358759 7/1976 France .

*Primary Examiner*—Neil Abrams

*Attorney, Agent, or Firm*—Frederick W. Raring; Adrian J. LaRue; Anton P. Ness

[57] ABSTRACT

Cylindrical electrical assembly comprises a plug part and a receptacle part, each part consisting of a metallic shell and an insulating insert within the shell. The insert of the receptacle part has an integral hood which extends forwardly beyond the mating face of the receptacle insert and which receives forward portions of the plug insert. The shell of the receptacle part also has an integral hood which extends forwardly, and is radially spaced from, the hood of the insert. Forward portions of the plug shell are received between the hood of the receptacle insert and the hood of the receptacle shell. The internal surfaces of the hoods of the receptacle shell and the receptacle insert are each provided with keyways. These keyways receive integral keys on the plug shell and the forward portions of the plug insert. Distinctive keying of the connector assembly is achieved by mounting the inserts in the shells at preselected locations in an angular sense so that the connector parts cannot be mated with parts that are identical except for a different keying option.

4 Claims, 2 Drawing Sheets

CYLINDRICAL CONNECTOR KEYING MEANS

RELATED APPLICATION INFORMATION

This is a continuation of U.S. patent application Ser. No. 235,455 filed Feb. 18, 1981, now abandoned.

FIELD OF THE INVENTION

This invention relates to cylindrical electrical connector assemblies of the type comprising a plug part and a receptacle part. The invention is particularly directed to connector assemblies having improved protective shells and improved keying means.

BACKGROUND AND SUMMARY OF THE INVENTION

U.S. Pat. No. 3,901,574 discloses and claims a cylindrical electrical connector assembly comprising a connector plug and a connector receptacle. The plug part has a rotational coupling ring thereon which has internal threads that mate with external threads on the surface of the receptacle, the arrangement being such that when the parts are mated, the coupling ring is rotated to draw or pull the plug and receptacle together until the contact terminals in the two parts are fully engaged with each other. The connector assembly described in U.S. Pat. No. 3,901,574 is entirely of molded plastic parts and it can therefore be produced at a significantly lower cost than conventional cylindrical electrical connectors which consist of a plastic insert mounted in a metallic shell. Connectors of the type disclosed in the above identified U.S. Pat. No. have many of the advantages of conventional cylindrical electrical assemblies and can therefore be used under circumstances where the cost of a composite cylindrical connector (the type comprising a metallic shell and an insert) cannot be justified.

While connectors of the type shown in U.S. Pat. No. 3,901,574 are presently being widely used, it would be desirable to provide as an option a low-cost metallic shell on the plug part and on the receptacle part of the assembly. A low-cost shell on the connector parts would be desirable where the connector assembly is used under severe conditions and where it will necessarily be subjected to abusive treatment. It would also be desirable to provide a metallic shell on a connector assembly shown in U.S. Pat. No. 3,901,574 for shielding purposes under many conditions.

It is accordingly one of the objects of the present invention to provide a low-cost cylindrical electrical connector having metallic shells in surrounding relationship to the insulating inserts of the connector assembly.

In accordance with a further aspect thereof, the invention is directed to the achievement of improved keying means for cylindrical electrical connectors. It is presently common practice to provide on the mating parts of a connector assembly keys and keyways which permit mating of the two connector parts only when they are in the proper angular orientation for mating; however, it frequently happens that two or more electrical connector assemblies will be used in close proximity to each other and under circumstances where a technician might inadvertently mismate the connector parts of the two connector assemblies. It would be desirable to be able to key the parts uniquely to each other so that such mismating would be impossible. The present invention is directed to the achievement of a keying system which does permit, and provide for, unique keying arrangements for connector assemblies which prevent mismating with connector parts of adjacent connector assemblies.

A preferred embodiment of the invention comprises a connector plug part and a receptacle part, each part comprising a molded insert and a cylindrical shell within which the insert is fitted and retained. The insert of the receptacle part has an integral hood which extends beyond the mating face of the receptacle insert and the shell of the receptacle also has a hood which extends forwardly beyond the insert hood. The plug part comprises an insert and a shell which has an internal surface that is radially spaced from the external surface of the plug insert so that when the two parts are mated, the hood of the receptacle insert will be received between the external surface of the plug insert and the internal surface of the plug shell. The hood of the receptacle shell extends over the external surface of the plug shell when the parts are mated and threads or the like on the external surface of the receptacle shell hood are engaged by threads provided on the internal surface of a coupling ring which is rotationally mounted on the plug shell.

Insert keying means are provided on the external surface of the plug insert and on the internal surface of the hood portion of the receptacle insert defining a first unique keying system, so that these two inserts can be mated only when this keying means is satisfied. Additional keying means are provided on the external surface of the plug shell and on the internal surface of the receptacle shell hood defining a second unique keying system, and this additional keying means must also be aligned before the two connector parts can be coupled to each other. Distinctive or unique keying for a particular connector assembly is achieved when the inserts are assembled to the shells of the two connector parts by mounting the inserts at predetermined locations with a predetermined angular relationship between the insert keying means and the shell keying means. A particular connector assembly having its own distinctive angular relationship between the two keying means cannot therefore be mated with an adjacent connector assembly having a different angular relationship between the two keying means.

DETAILED DESCRIPTION OF THE PREFERRED EMBODIMENT

Figures 1, 4:
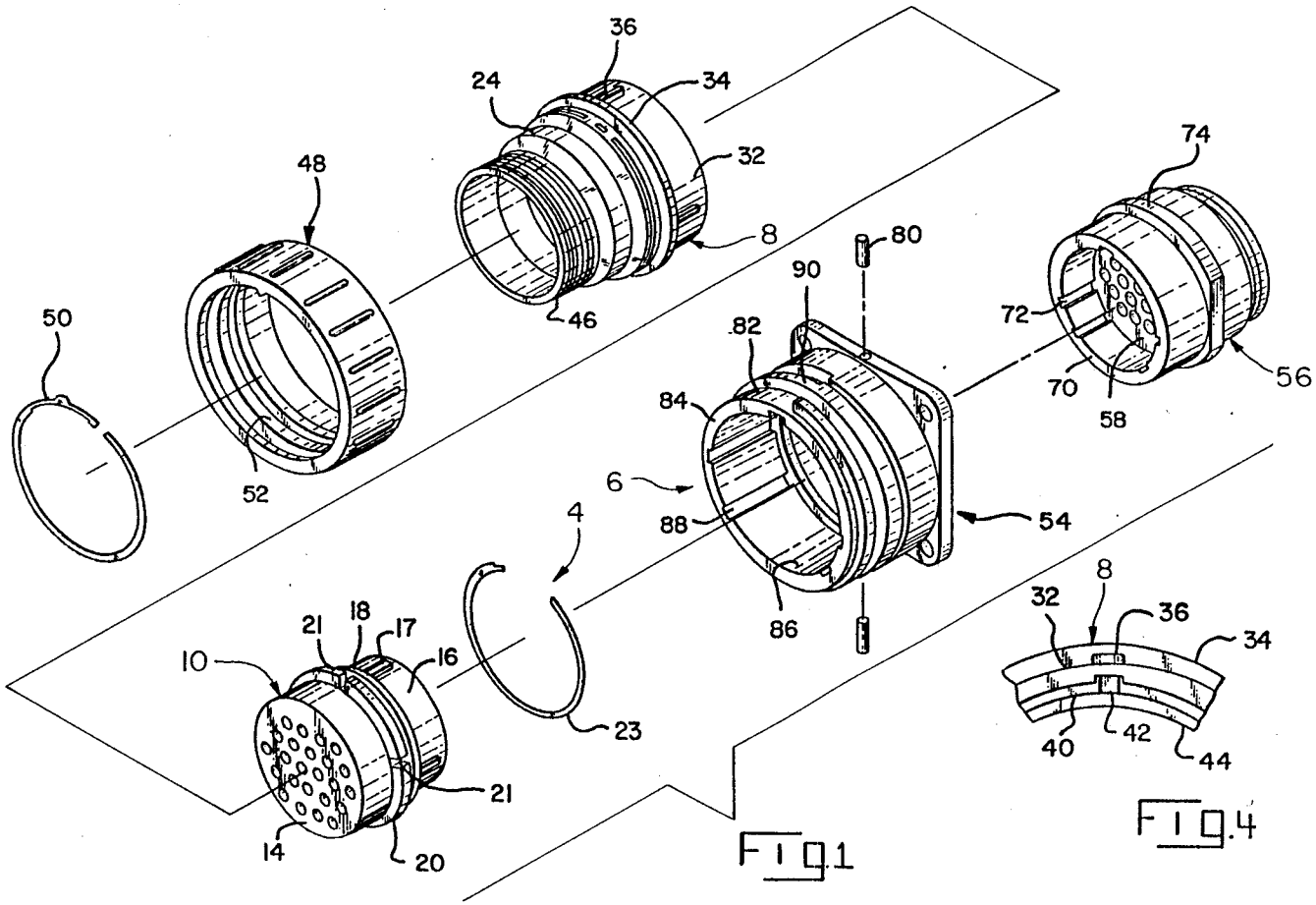
FIG. 1 is a perspective view of a connector assembly in accordance with the invention in which all of the parts are exploded from, and in alignment with, each other.
FIG. 4 is a fragmentary frontal view of the metallic shell of the plug part.
Figure 2:
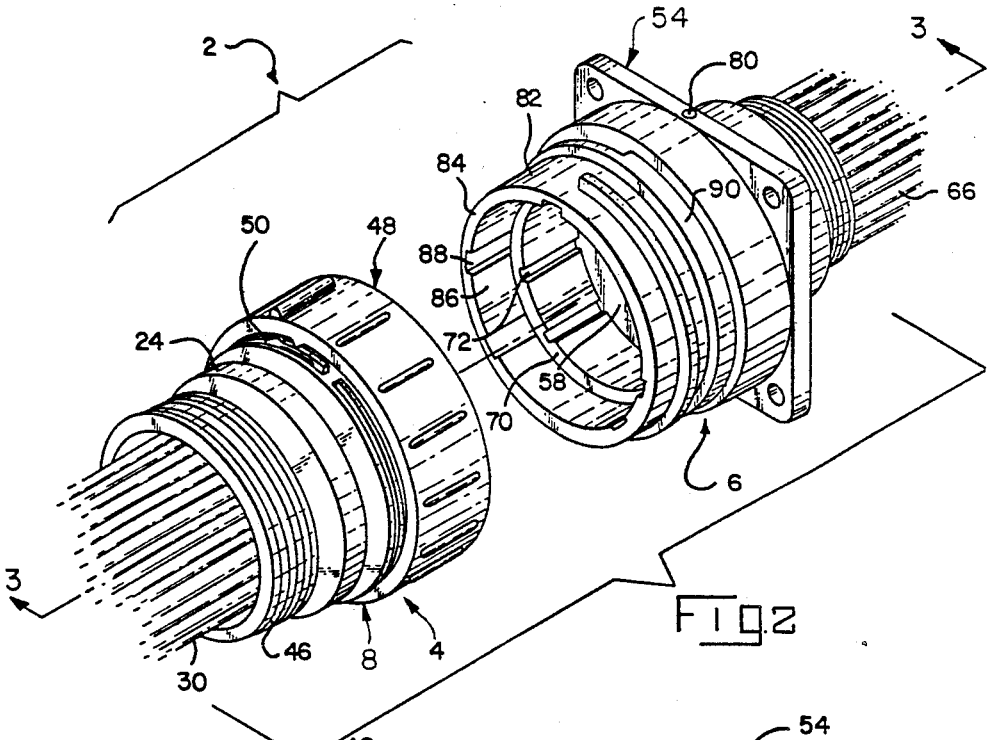
FIG. 2 is a perspective view of a plug part and a receptacle part in opposed aligned relationship.

A connector assembly 2 in accordance with the invention comprises a plug part 4 and a receptacle part 6, each part containing contact terminals which are engaged with each other when the parts are coupled thereby electrically to connect wires 30 to wires 66, as seen in FIG. 1.

The plug part 4 comprises a cylindrical metallic shell 8 having a plastic molded first insert 10 therein. Insert 10 has a mating surface or face 12, a wire entry face 14 at its rearward end, and a cylindrical surface having keys and spaced-apart ribs thereon as described below. Forward portion 16 of the cylindrical surface of insert 10 extends from mating face 12 to a first circumferential rib 18 and has a plurality of axially extending keys 17 thereon at irregularly spaced angular intervals, thereby being asymmetrically disposed around the insert, and extending from a location adjacent to mating face 12 to rib 18. A second circumferential rib 20 is located rearwardly of rib 18 so that a recess 22 is formed which receives a locking ring 23 by means of which insert 10 is retained in shell 8.

Figure 3:
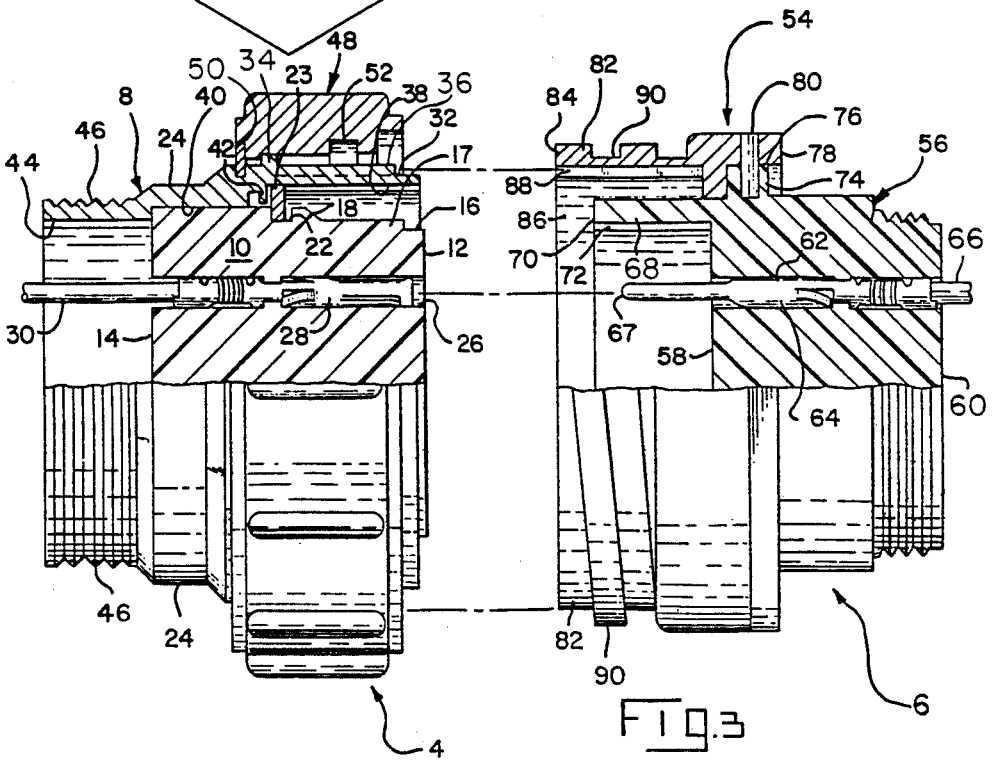
FIG. 3 is a view taken along the lines 3—3 of FIG. 2.

A plurality of terminal-receiving cavities 26 extend through insert 10 from face 14 thereof to mating face 12, each cavity 26 having a socket contact terminal 28 therein as shown in FIG. 3. Terminals 28 are crimped onto wires 30 which extend rearwardly from insert 10 and from shell 8.

The shell 8 has a forward portion 32, an intermediate circumferential rib 34 on its external surface, and a rearward portion 24 which extends rearwardly beyond wire entry face 14 of insert 10. A plurality of integral keys 36 are provided on the forward portion 32 of the shell 8 at selected irregularly spaced locations asymmetrically therearound, and extend from a location adjacent to the leading edge of shell 8, axially to rib 34. The internal surface 38 of forward portion 32 of shell 8 is radially spaced from cylindrical surface of forward portion 16 of insert 10 by an amount sufficient to receive a hood 68 which is integral with insert 56 of receptacle part 6 as will be described below. The internal surface of intermediate portion 40 of shell 8 is of reduced diameter, and the rearward portion of insert 10 is dimensioned to have a relatively close fit within this intermediate portion 40 of shell 8. The insert 10 is thus assembled to shell 8 by simply moving insert 10 into forward portion 32 of shell 8 until the rearward portion of the insert 10 is snugly seated in reduced diameter intermediate portion 40 of shell 8. As previously mentioned, insert 10 is retained in shell 8 by means of a suitable snap ring 23 which bears against the surface of rib 20.

The angular relationship of insert 10 to metallic shell 8 is determined by a locating tooth 42 on the internal surface of the shell 8 and a plurality of gaps or recesses 21 in rib 20. The insert 10 can thus be positioned in any one of several rotational positions in shell 8 depending upon which one of several gaps 21 is aligned with tooth 42 at the time of assembly of insert 10 to shell 8.

A coupling ring 48 is rotatively mounted on forward portion 32 of shell 8 and retained against axial movement by means of a snap ring 50 which is received in a suitable recess in coupling ring 48 and in a circumferential groove in intermediate portion 40 of the shell 8. The coupling ring 48 is retained between snap ring 50 and an integral rib 34 on shell 8 as shown. The internal surface of coupling ring 48 is provided with screw threads 52 or their equivalent for cooperation with threads 90 on second or receptacle shell 54, as seen in FIG. 3.

The second insert 56 of receptacle part 6 has a mating face 58, a wire entry face 60, and a plurality of cavities 62 extending therethrough, each of which contains a contact pin 64 crimped onto a wire 66. The contact pins 64 have contact portions 67 which extend beyond mating surface or face 58 and which are dimensioned to be received in sockets 28. The insert 56 has a continuous integral hood 68 which surrounds and extends forwardly from mating face 58. The leading edge 70 of hood 68 is located beyond ends of contact portions 67 of contact pins 64 and is recessed from leading edge 84 of hood portion 82 of the continuous shell hood. The internal surface of insert hood 68 is provided with keyways 72 located to receive integral keys 17 on plug insert 56, which keys 17 and keyways 72 extend axially rearwardly from the leading edges of inserts 56 and 10 respectively. The selected arrangement of keys 17 and corresponding keyways 72 of inserts 10, 56 define a second unique keying system.

A circumferential rib 74 on insert 56 is received within a counterbore 76 in rearward end of receptacle shell 54 and the insert 56 is retained in shell 54 by means of one or more pins 80 which are driven radially through shell and into rib 74. The shell hood 82 has an internal surface 86 which is spaced from the external surface of insert hood 68 and is provided with keyways 88 which are dimensioned to receive keys 36 on plug shell 8, which keys 36 and keyways 88 extend axially rearwardly from the leading edges of shells 54 and 8 respectively. The selected arrangement of keys 36 and corresponding keyways 88 of shells 8, 54 define a first unique keying system, and together with the second unique keying system define an overall unique keying arrangement for the connector assembly.

When a connector assembly in accordance with the invention is first assembled, plug insert 10 is positioned in plug shell 8 in a predetermined orientation relative to plug shell 8 which is determined by the particular gap or recess 21 which is aligned with tooth 42 at the time of assembly. When receptacle insert 56 is assembled to receptacle shell 54, it is necessary to assemble these parts in the same relative positions as that selected for plug insert 10 and shell 8. When the assembly is thereafter put to use, the technician must then align keys 17, 36 and keyways 72, 88 on plug part 4 and on receptacle part 6 before he can locate coupling nut 48 and draw the two parts together. If the technician attempts to mate two connector parts which are not keyed to each other, he will find it impossible to move them sufficiently close together to permit threads 52, 90 on coupling nut 48 and on receptacle shell 54 to engage. It is thus impossible to mismate the parts of adjacent connector assemblies which are not specifically keyed to each other.

The practice of the invention provides a low-cost cylindrical connector assembly since the inserts can be the same as the connector parts described in U.S. Pat. No. 3,901,574. The plastic coupling nut shown in this Patent is not provided on the plug and the external threads shown in that Patent on the receptacle need not, of course, be provided in the practice of the present invention. The metallic shells used in the practice of the invention are advantageously die castings and can therefore be produced at low cost and are easily assembled to the inserts as described above.

What is claimed is:

1. An electrical connector assembly, comprising:

plug means including first shell means having first insert means disposed therein, said first insert means having first passageway means extending therethrough, first electrical terminal means secured in said first passageway means, first means on said first shell means and said first insert means securing said first insert means at a selected angular position relative to said first shell means and securing said first shell means and said first insert means together;

receptacle means including second shell means having second insert means disposed therein, said second insert means having second passageway means extending therethrough, second electrical terminal means secured in said second passageway means, second means on said second shell means and said second insert means securing said second insert means in said second shell means at a selected angular position relative to said second shell means;

coupling means on said first and second shell means coupling said first and second shell means, said first and second insert means, and said first and second electrical terminal means together, after angularly aligned mating thereof;

said first and second insert means having mating surfaces for engagement with each other when electrical contact sections of said electrical terminal means are electrically connected together, said second insert means having a continuous hood means surrounding the electrical contact sections of said second electrical terminal means extending outwardly from said mating surface of said second insert means and encompassing a forward section of said first insert means when said mating surfaces are engaged and said electrical contacts sections are electrically connected;

said first shell means having a circumferentially continuous forward portion having an internal surface radially spaced from said forward section of said first insert means such that said plug means is capable of encompassing a forward section of said hood means of said second insert means when said mating surfaces are engaged and said electrical contact sections are electrically connected;

said second shell means having a continuous hood means radially spaced from an external surface of said continuous hood means of said second insert means such that said receptacle means is capable of encompassing a forward section of said first shell means between said shell hood means and said insert hood means when said mating surfaces are engaged and said electrical contact sections are electrically connected, and said second shell hood means having a leading edge extending farther forward than the leading edge of said second insert hood means;

a first unique keying system of said connector assembly defined by key means and corresponding keyway means provided on said first and second shell means disposed at selected locations asymmetrically around and extending axially rearwardly from leading edges of said first and second shell means, said shell keyway means to receive said shell key means during mating of matchingly keyed ones of said plug means and said receptacle means;

a second unique keying system of said connector assembly defined by key means and corresponding keyway means provided on said first and second insert means disposed at selected locations asymmetrically around and extending axially rearwardly from leading edges of said first and second insert means, said insert keyway means to receive said insert key means during mating of matchingly keyed ones of said plug means and said receptacle means, whereby said shell key means and keyway means defining said first keying system must cooperatingly engage before said insert key means and keyway means defining said second keying system cooperatingly engage during mating of said plug means and said receptacle means; and said selected angular position of said second insert means in said second shell means is selected relative to said selected angular position of said first insert means secured in said first shell means, such that said insert key and keyway means are capable of cooperatingly engaging during mating after said shell key and keyway means have cooperatingly engaged, in a unique keying arrangement for said plug means and said receptacle means to prevent mismating of one thereof with another means similar to the other thereof.

2. An electrical connector assembly as set forth in claim 1 wherein said shell key means comprises keys on the external surface of said forward portion of said first shell means, and said shell keyway means comprises keyways on the internal surface of said hood means of said second shell means.

3. An electrical connector assembly as set forth in claim 1 wherein said insert key means comprises keys on the external surface of said forward section of said first insert means, and said insert keyway means comprises keyways on the internal surface of said hood means of said second insert means.

4. An electrical connector assembly as set forth in claim 1 wherein said second insert means is press fitted into said second shell means and is retained therein by retaining pin means extending radially through said second shell means and into said second insert means.

* * * * *